US006113531A

United States Patent [19]

Leysieffer et al.

[11] Patent Number: 6,113,531

[45] Date of Patent: Sep. 5, 2000

[54] PROCESS FOR OPTIMIZATION OF MECHANICAL INNER EAR STIMULATION IN PARTIALLY OR FULLY IMPLANTABLE HEARING SYSTEMS

[75] Inventors: Hans Leysieffer, Taufkirchen; Hans Peter Zenner, Tübingen, both of Germany

[73] Assignee: IMPLEX Aktiengesellschaft Hearing Technology, Ismaning, Germany

[21] Appl. No.: 09/193,844

[22] Filed: Nov. 18, 1998

[51] Int. Cl.[7] ..... H04R 25/00

[52] U.S. Cl. ..... 600/25; 600/559

[58] Field of Search ..... 600/25, 559

[56] References Cited

U.S. PATENT DOCUMENTS

| | | | |
|---|---|---|---|
| 3,712,962 | 1/1973 | Epley . | |
| 3,870,832 | 3/1975 | Fredrickson . | |
| 3,882,285 | 5/1975 | Nunley et al. . | |
| 4,622,967 | 11/1986 | Schachar | 128/303.15 |
| 4,850,962 | 7/1989 | Schaefer . | |
| 5,015,224 | 5/1991 | Maniglia . | |
| 5,277,694 | 1/1994 | Leysieffer et al. . | |
| 5,476,446 | 12/1995 | Arenburg | 604/21 |
| 5,554,096 | 9/1996 | Ball . | |
| 5,788,711 | 8/1998 | Lehner et al. . | |
| 5,993,376 | 11/1999 | Kennedy | 600/25 |

OTHER PUBLICATIONS

Fredrickson et al., Ongoing Investigations into an Implantable Electromagentic Hearing Aid for Moderate to Severe Sensorineural Hearing Loss, Otolaryngologic Clincs of North America, vol. 28, No. 1, (1995), pp. 107–121.

Leysieffer et al., Ien Implantierbarer Piezo–Elektrischer Hörgerätewandler Für Innenohrschwerhörige, HNO 1997, 45, pp. 792–800.

Maniglia et al., Contactless Semi–Implantable Electromagnetic Middle Ear Device for the Treatment of Sensorineural Hearing Loss, The Otolaryngologic Clinics of North America, vol. 28, No. 1, Feb. 1995, pp. 121–141.

Suzuki et al., Implantation of Partially Implantable Middle Ear Implant and the Indication, Adv. Audiol., vol. 4, Karger Basel (1988), pp. 160–166.

Yanigahara et al., Efficacy of the Partially Implantable Middle Ear Implant In Middle and Inner Ear Disorders, Adv. Audiol., vol. 4, Karger Basel (1988), pp. 149–159.

Zenner, Leysieffer, Aktive Elektronische Hörimplantate Für Mittel– Und Innenohrschwerhörige—Eine Neue Ära Der Ohrchirurgie, HNO 1997, 45, pp. 749–774.

*Primary Examiner*—Max Hindenburg
*Assistant Examiner*—Brian Szal
*Attorney, Agent, or Firm*—Nixon Peabody LLP; David S. Safran

[57] ABSTRACT

In a process for optimization of mechanical inner ear stimulation in an at least partially implantable hearing system for rehabilitation of a hearing impairment with an electromechanical converter which transmits its output-side mechanical vibrational energy via mechanical stimulation of a middle ear ossicle to the damaged inner ear, the ossicular chain is mechanically interrupted such that co-vibration of the eardrum and thus loss of part of the energy supplied by the electromechanical converter by acoustic sound emission is prevented. The process optimizes the flow of mechanical energy supplied by the electromechanical hearing aid converter in the direction of the inner ear.

20 Claims, 2 Drawing Sheets

PROCESS FOR OPTIMIZATION OF MECHANICAL INNER EAR STIMULATION IN PARTIALLY OR FULLY IMPLANTABLE HEARING SYSTEMS

BACKGROUND OF THE INVENTION

1. Field of the Invention

The invention relates to a process for optimization of mechanical inner ear stimulation with an at least partially implantable hearing system for rehabilitation of a hearing impairment. In particular, the invention relates to a process of this type in which the hearing system has an electromechanical converter which transmits its output-side mechanical vibrational energy, via mechanical stimulation of a middle ear ossicle, to a damaged inner ear.

2. Description of Related Art

Electronic measures for rehabilitation of inner ear damage which cannot be cured by surgery have currently achieved great importance. With total failure of the inner ear, cochlear implants with direct electrical stimulation of the remaining auditory nerves are in routine clinical use. For medium to severe inner ear damage, for the first time, fully digital hearing devices are presently being used which open up a new world of electronic audio signal processing and offer expanded possibilities of controlled audiological fine tuning of the hearing devices to the individual inner ear damage. In spite of major improvements of hearing aid hardware achieved in recent years, in conventional hearing aids, there remain basic defects which are caused by the principle of acoustic amplification, i.e. especially by the reconversion of the electronically amplified signals in airborne sound. These defects include aspects such as the visibility of the hearing aids, poor sound quality as a result of electromagnetic converters (speakers), closed external auditory canal as well as feedback effects with high acoustic gain.

As a result of these fundamental defects, there has long been the desire to move away from conventional hearing aids with acoustic stimulation of the damaged inner ear and to replace them by implants with direct mechanical stimulation. Implantable hearing aids differ from conventional hearing aids: the acoustic signal is converted with a proper microphone into an electrical signal and amplified in an electronic signal processing stage; this amplified electrical signal, however, is not sent to an electroacoustic converter (speaker), but to an implanted electromechanical converter with output-side mechanical vibrations which are sent directly, therefore with direct mechanical contact, to the middle ear or inner ear, or indirectly via an air gap in, for example, electromagnetic converter systems. This principle applies regardless of whether implantation of all necessary system elements is partial or complete and also regardless of whether an individual with pure inner ear impairment with a completely intact middle ear or an individual with combined hearing impairment, in which the middle and inner ear is damaged, is to be rehabilitated.

Electromechanical converter processes include basically all physical conversion principles, such as electromagnetic, electrodynamic, magnetostrictive, dielectric and piezoelectric. Various research groups, in recent years, have focused essentially on two of these processes, specifically electromagnetic and piezoelectric processes. A survey can be found in ZENNER and LEYSIEFFER (HNO October 1997, pp. 749–774).

In the piezoelectric process, direct mechanical coupling of the output-side converter vibrations to the middle ear ossicle or to the oval window is essential. In the electromagnetic principle, force coupling between the converter and ossicle, on the one hand, can take place "without contact", i.e. via an air gap; in this case, only the permanent magnet is caused to vibrate by the converter being in direct mechanical contact with the middle ear ossicle by permanent fixation. On the other hand, it is possible to implement the converter entirely in a housing (in this case the coil and the magnet preferably being coupled with the smallest possible air gap) and to transmit the output-side vibrations via a mechanically stiff coupling element with direct contact to the middle ear ossicle (see FREDRICKSON et al.: Ongoing investigations into an implantable electromagnetic hearing aid for moderate to severe sensorineural hearing loss; Otolaryngologic Clinics of North America, Vol. 28/1 (1995), pp. 107–121; and Leysieffer et al., HNO October 1997, pp. 792–800).

The patent literature contains some of the aforementioned versions of both electromagnetic and also piezoelectric hearing aid converters: U.S. Pat. No. 3,712,962, EPLEY; U.S. Pat. No. 3,870,832, FREDRICKSON; U.S. Pat. No. 3,882,285, NUNLEY; U.S. Pat. No. 5,277,694, LEYSIEFFER et al.; U.S. Pat. No. 5,015,224, MANIGLIA; U.S. Pat. No. 4,850,962, SCHAEFER; U.S. Pat. No. 5,554,096, BALL.

The partially implantable piezoelectric hearing system of the Japanese group of Suzuki and Yanigahara presupposes, for implantation of the converter, the absence of a middle ear ossicle and a free tympanic cavity to be able to couple the piezoelement to the stapes (Yanigahara et al.: Efficacy of the partially implantable middle ear implant in middle and inner ear disorders: Adv. Audiol., Vol. 4, Karger Basel (1988), pp. 149–159, Suzuki et al.: Implantation of partially implantable middle ear implant and the indication. Adv. Audiol., Vol. 4, Karger Basel (1988), pp. 160–166). Likewise, in the method of implanting a hearing system for inner ear hearing-impaired according to SCHAEFER (U.S. Pat. No. 4,850,962) basically the incus is removed in order to be able to couple a piezoelectric converter element to the stapes.

The BALL electromagnetic converter ("Floating Mass Transducer FMT" of U.S. Pat. No. 5,554,096) is, on the other hand, fixed directly to the long process of the incus when the middle ear is intact. The electromagnetic converter of the partially implantable system of FREDRICKSON (Fredrickson et al.: Ongoing investigations into an implantable electromagnetic hearing aid for moderate to severe sensorineural hearing loss, Otolaryngologic Clinics of North America, Vol. 28/1 (1995), pp.107–121) is mechanically coupled directly to the body of the incus when the ossicle chain of the middle ear is likewise intact. The same applies to the piezoelectric converter of LEYSIEFFER (LEYSIEFFER et al.: An implantable piezoelectric hearing aid converter for the inner ear hearing-impaired. HNO 1997/45, pp. 792–800). Also in the electromagnetic converter system of MANIGLIA (MANIGLIA et al.: Contactless semi-implantable electromagnetic middle ear device for the treatment of sensorineural hearing loss, Otolaryngologic Clinics of North America, Vol. 28/1 (1995), pp. 121–141) with the ossicular chain intact a permanent magnet is permanently mechanically fixed to the ossicular chain, but is mechanically driven via an air gap coupling by a coil.

In these latter converter systems of partially or fully implantable hearing systems in which the ossicular chain of the middle ear remains unchanged, there is the disadvantage that the mechanical vibration energy which is supplied to the ossicular chain by the electromechanical transducer is divided: one part goes as desired to the inner ear, the other part is transmitted via the existing coupling to the hammer (malleus), and thus, emitted by the eardrum as acoustic sound energy to the outside into the external auditory canal, and is thus, not available for stimulation of the damaged inner ear.

SUMMARY OF THE INVENTION

In view of the above described defects of known hearing systems, a primary object of this invention, is to improve mechanical inner ear excitation of an at least partially implantable hearing system for rehabilitation of a hearing-impairment with an electromechanical converter which transmits its output-side mechanical vibration energy, via mechanical stimulation of a middle ear ossicle, to a damaged inner ear.

It is a particular object of the invention to devise a process by which the vibrational energy supplied by the converter to the ossicular chain of the middle ear is optimally transmitted to the inner ear.

These objects are achieved in accordance with the present invention for an at least partially implantable hearing system for rehabilitation of a hearing impairment with an electromechanical converter which transmits its output-side mechanical vibrational, energy via mechanical stimulation of the middle ear ossicle, to the damaged inner ear, by the ossicular chain being mechanically interrupted by surgery such that concomitant vibration of the eardrum, and thus, loss of some of the energy supplied by the electromechanical converter by acoustic emission, are prevented. In this way, the flow of mechanical energy supplied by the electromechanical hearing aid converter in the direction of the inner ear is optimized. Depending on the coupling site of the electromechanical converter, for purposes of severing the ossicular chain, transection, partial resection or full resection of one or more ossicles of the middle ear chain, i.e. of the hammer (malleus), the anvil (incus) or the stirrup (stapes) can be performed.

Here, the term "hearing impairment" is defined as pure inner ear hearing impairment or a combined hearing impairment.

As mentioned initially, mechanical stimulation of the middle ear ossicle can be produced by means of direct stimulation or by means of stimulation coupled via an air gap.

The ossicular chain is severed for reasons of the simplest possible reconstruction of a removal of the converter, which has become necessary in case of a fault, and restoration of the preoperative state of the middle ear as distally as possible, i.e. as near the eardrum as possible. In a partial or complete resection of one or more ossicles, the process takes place such that as many bands of the middle ear as possible which hold the ossicles are preserved in order to ensure residual mechanical stability of the remaining middle ear portions as much as possible.

According to this invention, the following measures are possible to mechanically interrupt the ossicular chain:

When the converter is coupled to the hammer (malleus), anvil (incus) or stirrup (stapes):
- Freeing of the manubrium mallei from the eardrum
- Severance of the collum of the malleus
- Removal of the head of the malleus When the converter is coupled to the body of the incus or the stirrup (stapes):
- complete removal of the hammer (malleus)
- severance of the body of the incus When the transducer is coupled to the long process of the incus:
- severance of the long process of the incus viewed distally from the coupling site Severance of the ossicular chain can be produced by purely mechanical intervention (cutting tools), or better and preferably, by using suitable laser systems, such as an Er:YAG laser. When a laser is used, preferably, a pulsed mode with low laser energy of the individual pulses and a low repetition rate of the individual pulses is selected to reliably prevent inner ear damage as a result of the supplied mechanical cutting energy, such as, for example, a temporary auditory threshold shift (TTS) or permanent threshold shift (PTS).

These and further objects, features and advantages of the present invention will become apparent from the following description when taken in connection with the accompanying drawings which, for purposes of illustration only, shows a single embodiment in accordance with the present invention.

DETAILED DESCRIPTION OF THE INVENTION

Figure 1:
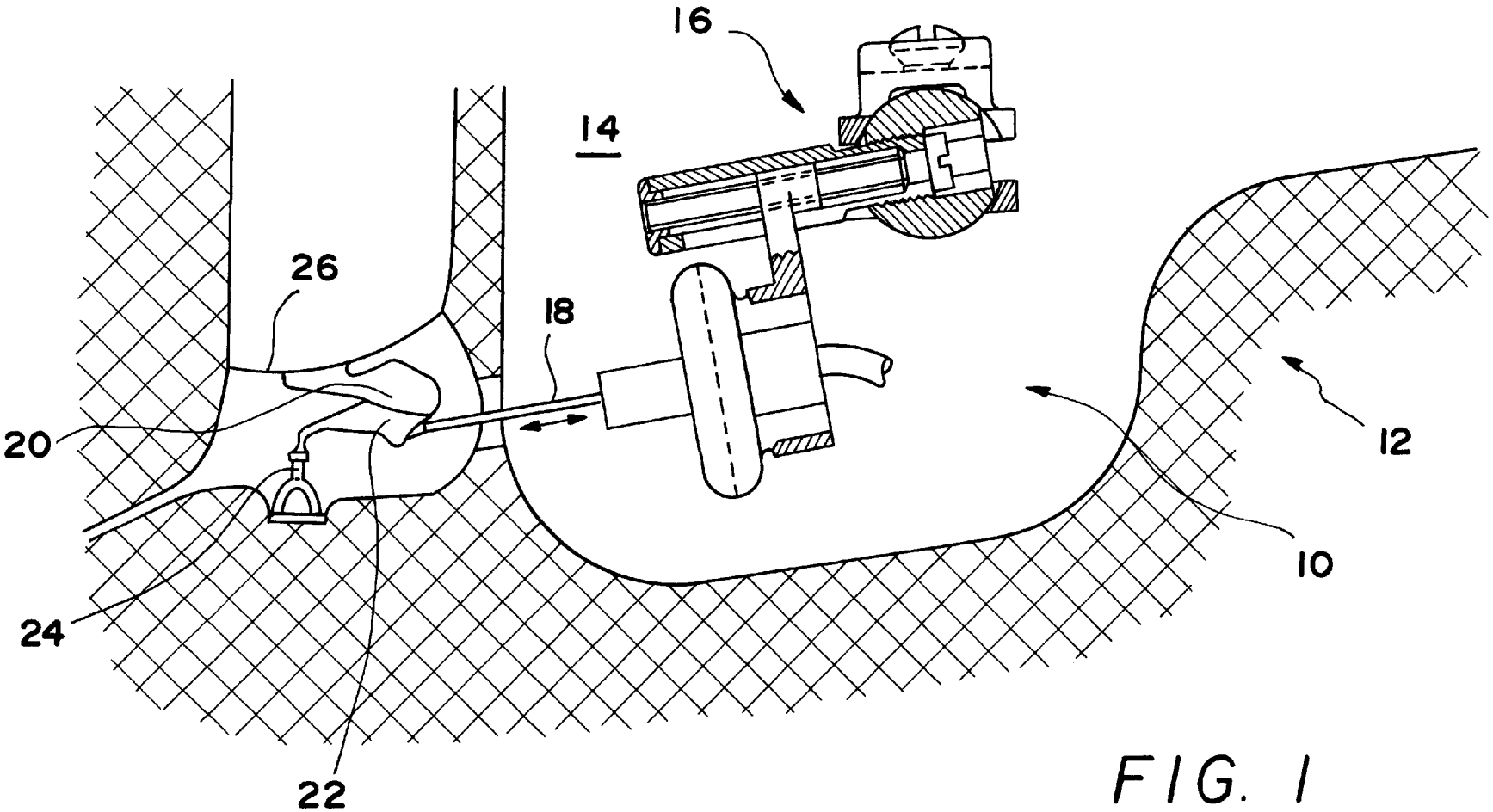
FIG. 1 shows a schematic of an implanted hearing system with an electromechanical converter which transmits its output-side mechanical vibrational energy via mechanical stimulation of a middle ear ossicle to the damaged inner ear.

FIG. 1 shows one example of a hearing system used in a manner which makes the invention especially advantageous. The hearing system described here comprises an implantable electromechanical converter 10 which converts the electrical signals produced by a signal source (not shown) into mechanical motion, especially motion of the coupling element 18 back and forth. The signal source can, for example, be an externally worn hearing aid or an implantable transducer which receives an input signal from a likewise implanted microphone so that the hearing system described here, depending on the type of signal source, can be a partially or fully implanted hearing system, as was described by Leysieffer et al. in the article An implantable piezoelectric hearing aid converter for the inner ear hearing-impaired, HNO 1997/45, pp. 792–800.

The converter 10 shown in FIG. 1 is housed in a mastoid cavity 14 that has been artificially formed in the temporal bone 12 and is held there, for example, by the positioning and fixing system 16 proposed by Lehner et al. in U.S. Pat. No. 5,788,711.

The converter 10 is coupled via the coupling element 18 to the ossicular chain of the middle ear which, as shown in FIG. 1, has a hammer (malleus) 20 which is connected to the eardrum 26, and an anvil (incus) 22 and stirrup (stapes) 24. In this example, the coupling element 18 engages the anvil (incus) 22.

To optimize mechanical stimulation of the inner ear, according to this invention, the ossicular chain is interrupted such that, when the ossicle connected to the coupling element is stimulated, co-vibration of the eardrum is prevented. This effectively prevents part of the energy supplied by the electromechanical converter from being lost in the form of acoustic sound emission from the eardrum. It goes without saying that severance of the ossicular chain must take place at a distal location from the coupling site in order to optimize the flow of mechanical energy which has been supplied by the electromechanical hearing aid converter in the direction to the inner ear.

Figure 2:
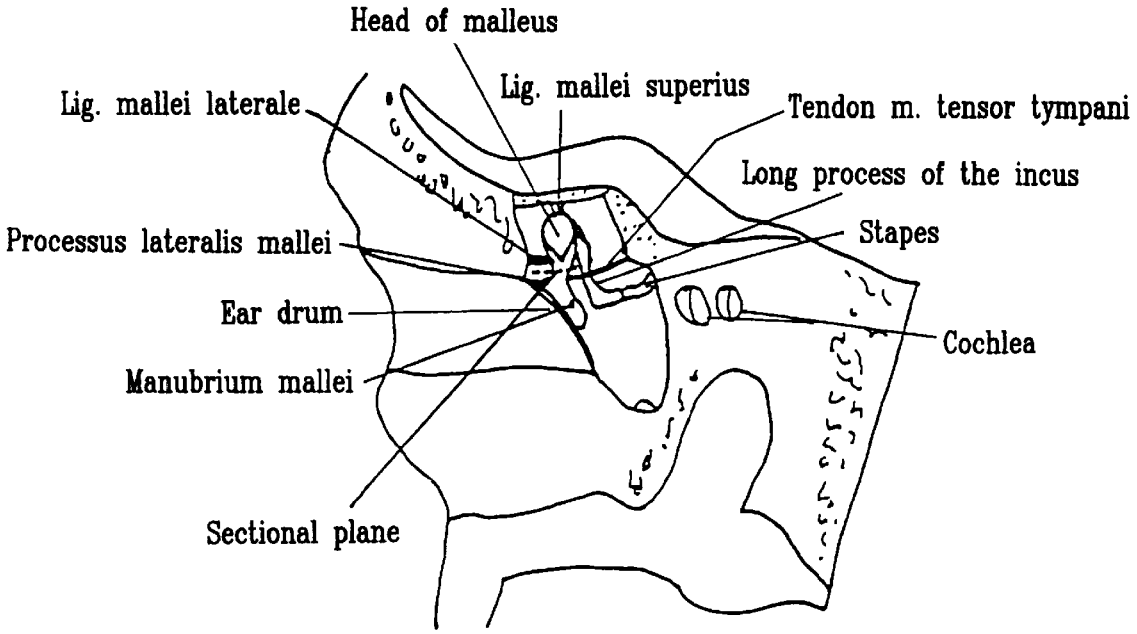
FIG. 2 is a schematic view of the outer and middle ear in which the ossicular chain is interrupted.

FIG. 2 shows another schematic section through the outer and middle ear; here, severance of the collum of the malleus is illustrated.

Via an enaural incision, the collum of the malleus is exposed and cut between the lateral process of the malleus (process lateralis mallei) and the ligamentum mallei superior as is indicated by the perforated line labelled "sectional plane" in FIG. 2. The tendon of the tensor tympany muscle is preserved. This procedure results in a disconnection of the eardrum from the ossicular chain.

In the surgical interruption of the ossicular chain, preferably a laser system is used, for example, a $CO_2$ laser, but preferably an Er:Yag laser. The laser is operated advantageously in the pulse mode, a maximum energy of the individual pulses of 50 mJ having proven especially advantageous. To prevent temporary or permanent threshold shift (TTS or PTS), the repetition rate of the individual pulses does not exceed 2 per second. If the object is to sever the ossicle, all the energy supplied should be less than 20 joules to prevent a temporary or permanent threshold shift (TTS or PTS).

Cutting of one ossicle, especially the collum of the malleus or the body of the incus, should produce a gap width in the range from 0.5 to 1.5 mm in order to reliably prevent later re-adhesion of the separation site and thus cancellation of the mechanical separation effect.

Instead of an electromechanical converter which transmits, according to FIG. 1, its output-side mechanical vibration energy via direct mechanical stimulation of a middle ear ossicle to the damaged inner ear, the process described here can be used, in the same way as, when using a hearing system which has an electromechanical converter in which mechanical stimulation of a middle ear ossicle takes place indirectly via an air gap.

If, after implantation of the hearing system or parts thereof, intolerance or a technical fault should result which necessitates a permanent removal of the electromechanical converter, reconstruction of the severance of the ossicle of the middle ear chain can be produced by interposition of an endogenous cartilage or bone piece or by surgical cement, for example, bone cement, in the severance gap. This applies especially to the case of severing of the collum of the malleus or the body of the incus.

We claim:

1. Process for optimization of mechanical inner ear stimulation in an at least partially implantable hearing system for rehabilitation of a hearing impairment with an electromechanical converter which transmits output-side mechanical vibrational energy via mechanical stimulation of a middle ear ossicle to a damaged inner ear, the ossicular chain being mechanically interrupted so as to prevent concomitant vibration of the eardrum and loss of some of the energy supplied by the electromechanical converter by acoustic emission, by which the flow of mechanical energy supplied by the electromechanical hearing aid converter in the direction of the inner ear is optimized, the mechanical interrupting of the ossicular chain being performed by a severing or partial resectioning of at least one middle ear ossicle in a manner creating a fillable gap which enables reconstruction of the ossicle upon removal of the hearing system.

2. Process as claimed in claim 1 in which the collum of the malleus is severed.

3. Process as claimed in claim 1 in which the converter is coupled to the body of the incus.

4. Process as claimed in claim 3, in which the body of the incus is severed.

5. Process as claimed in claim 1, in which the converter is coupled to the stirrup (stapes).

6. Process as claimed in claim 5, in which the body of the incus is severed.

7. Process as claimed in claim 1 in which the converter is coupled to the long process of the incus.

8. Process as claimed in claim 7, in which the long process of the incus, viewed distally from the coupling site, is severed.

9. Process as claimed in claim 1 in which a cutting instrument is used for mechanical interruption of the ossicular chain.

10. Process as claimed in claim 9, in which a hammerhead punch is used.

11. Process as claimed in claim 1 in which a laser is used for mechanical interruption of the ossicular chain.

12. Process as claimed in claim 11, in which the laser system comprises a $CO_2$ laser.

13. Process as claimed in claim 11, in which the laser system comprises an Er:Yag laser.

14. Process as claimed in claim 11, in which the laser system is operated in a pulse mode.

15. Process as claimed in claim 14, in which the energy of the individual pulses is a maximum of 50 mJ.

16. Process as claimed in claim 14, in which the laser system is operated such that it produces a maximum of 2 individual pulses per second.

17. Process as claimed in claim 11, in which, for purposes of severing a middle ear ossicle, the laser system is operated with a total supplied energy of a maximum of 20 joules.

18. Process as claimed in claim 1, in which, in the at least one middle ear ossicle to be severed, a gap with a width in the range from 0.5 to 1.5 mm is produced.

19. Process as claimed in claim 1 in which the converter transmits its output-side mechanical vibrational energy, via direct mechanical stimulation of a middle ear ossicle, to the damaged inner ear.

20. Process as claimed in claim 1, in which the converter transmits its output-side mechanical vibration energy, via mechanical stimulation of a middle ear ossicle, via an air gap to the damaged inner ear.

* * * * *